US010875320B2

(12) United States Patent
Fukuta et al.

(10) Patent No.: US 10,875,320 B2
(45) Date of Patent: Dec. 29, 2020

(54) PRINTER DEVICE

(71) Applicant: SEIKO EPSON CORPORATION, Tokyo (JP)

(72) Inventors: Hiroya Fukuta, Nagano (JP); Takeshi Yoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/283,899

(22) Filed: Feb. 25, 2019

(65) Prior Publication Data

US 2019/0263137 A1 Aug. 29, 2019

(30) Foreign Application Priority Data

Feb. 26, 2018 (JP) ..... 2018-032367

(51) Int. Cl.

| | |
|---|---|
| ***B41J 2/18*** | (2006.01) |
| ***B41J 2/175*** | (2006.01) |
| ***B41J 2/165*** | (2006.01) |
| ***B41J 29/38*** | (2006.01) |
| ***B41J 2/17*** | (2006.01) |
| *B41J 2/185* | (2006.01) |

(52) U.S. Cl.

CPC ..... *B41J 2/18* (2013.01); *B41J 2/16517* (2013.01); *B41J 2/16523* (2013.01); *B41J 2/16526* (2013.01); *B41J 2/1707* (2013.01); *B41J 2/17563* (2013.01); *B41J 2/17596* (2013.01); *B41J 29/38* (2013.01); *B41J 2002/1856* (2013.01)

(58) Field of Classification Search

CPC ..... B41J 2/17596

See application file for complete search history.

(56) References Cited

U.S. PATENT DOCUMENTS

| | | | | |
|---|---|---|---|---|
| 5,455,606 | A * | 10/1995 | Keeling | B41J 2/115 347/7 |
| 2009/0091779 | A1* | 4/2009 | Ishinaga | B41J 3/543 358/1.15 |
| 2017/0210126 | A1 | 7/2017 | Kato | |
| 2018/0093491 | A1* | 4/2018 | Murayama | B05B 9/0403 |

FOREIGN PATENT DOCUMENTS

| | | | |
|---|---|---|---|
| JP | 2014-172304 | A | 9/2014 |
| JP | 2015-182307 | A | 10/2015 |
| JP | 2017-132096 | A | 8/2017 |

* cited by examiner

*Primary Examiner* — Shelby L Fidler

(74) *Attorney, Agent, or Firm* — Global IP Counselors, LLP

(57) ABSTRACT

A printer device includes: an ink circulation flow path in which ink is circulated; a discharge head that discharges the ink supplied from the ink circulation flow path; a circulation pump and a circulation motor that circulate the ink in the ink circulation flow path; a circulation filter provided in the ink circulation flow path; and control unit that determines a blocked state of the circulation filter and performs drive control of the circulation motor in accordance with a determination result, and the control unit drives the circulation motor in a first mode until it is determined that the circulation filter is in a blocked state, and after it is determined that the circulation filter is in a blocked state, the control unit drives the circulation motor in a second mode that provides a smaller circulation rate than the first mode.

9 Claims, 6 Drawing Sheets

PRINTER DEVICE

BACKGROUND

1. Technical Field

The present invention relates to a printer device having an ink circulation flow path.

2. Related Art

In the conventional art, an ink jet printer in which an ink circulation flow path that circulates ink is provided in a supply flow path that supplies ink to a discharge head to suppress a change in hue due to sedimentation of ink sedimentation components is known (see, for example, JP-A-2014-172304). On the other hand, in some ink jet printers, to address agglomeration of ink, a carriage filter that filters agglomerated ink is provided inside a carriage on which a discharge head is mounted.

However, a filter provided in an ink circulation flow path may cause a problem of pressure control inside the ink circulation flow path when the filter is in a blocked state.

SUMMARY

According to an aspect of the invention, a printer device includes: an ink circulation flow path that circulates ink; an ink discharge unit that discharges the ink supplied from the ink circulation flow path; a circulation unit that circulates the ink in the ink circulation flow path; a filter provided in the ink circulation flow path; a determination unit that determines whether or not the filter is in a blocked state; and a control unit that controls the circulation unit, and the control unit drives the circulation unit in a first mode until the determination unit determines that the filter is in a blocked state, and after the determination unit determines that the filter is in the blocked state, the control unit drives the circulation unit in a second mode that provides a lower circulation rate than the first mode.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Embodiments of the invention will be described below in accordance with the attached drawings. As a printer device of the invention, an ink jet printer (hereinafter, referred to as a "printer") that forms a printing image by discharging ink onto a recording medium such as cloth will be described below as an example.

Figure 1:
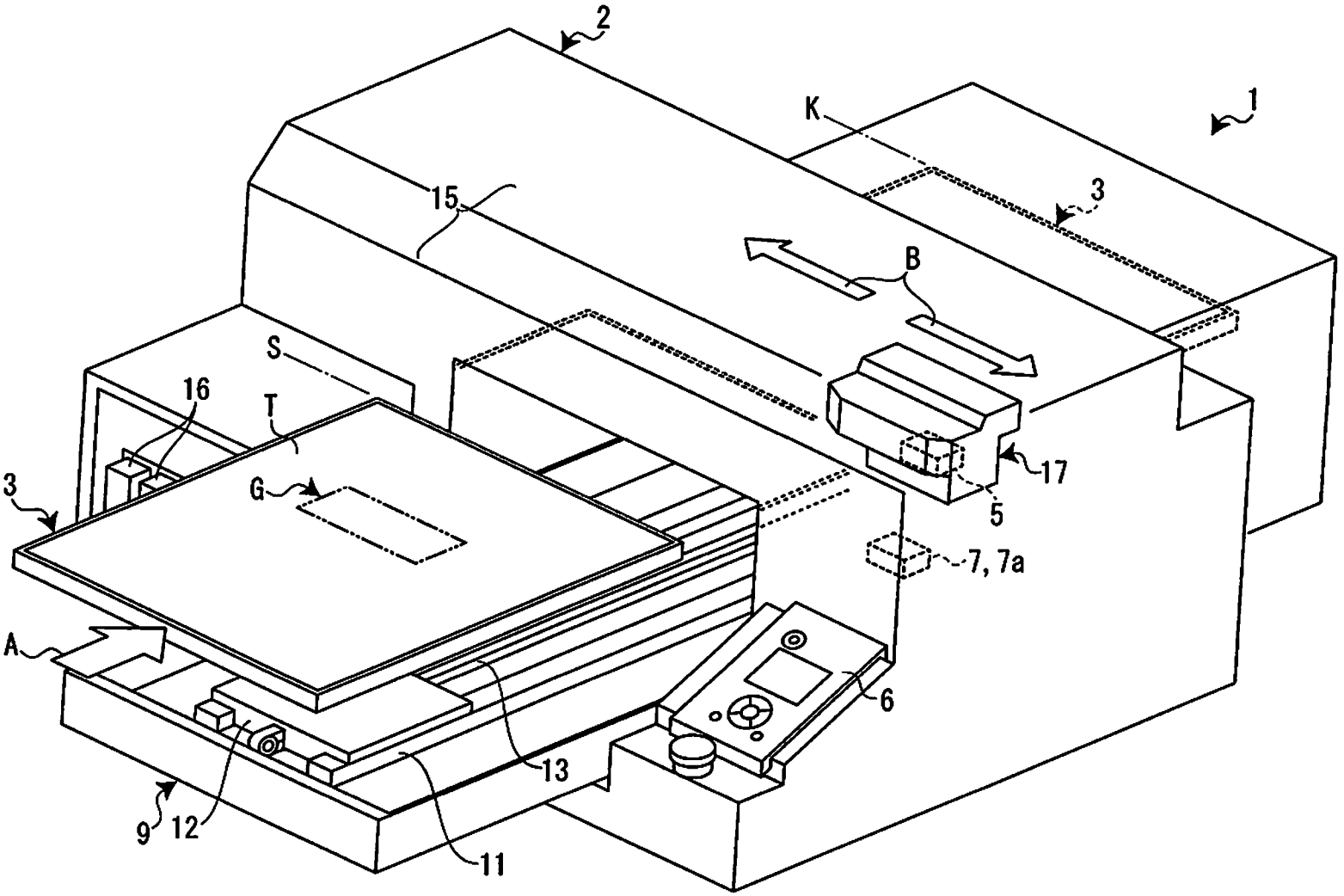
FIG. 1 is a perspective diagram illustrating a basic configuration of a printer.

FIG. 1 is a perspective view illustrating a basic configuration of a printer 1. The printer 1 includes a set tray 3 on which a recording medium T is set, a motion unit 9 that moves the set tray 3, a discharge head 5 that discharges ink onto the recording medium T, a carriage 17 on which a discharge head 5 is mounted, and an operating panel 6 that is a user interface. The discharge head 5 is an example of an ink discharge unit of the invention.

The motion unit 9 includes a support base 11 extending in a motion direction A of a device main unit 2 of the printer 1, a support stage 12 provided so as to be able to reciprocate in the motion direction A at the center of the support base 11, and a timing belt 13 that drives the support stage 12. The motion unit 9 causes the set tray 3 attached to the upper face of the support stage 12 to move between a setting position S at which the printing medium T is set or removed and a print start position K at which printing is started. A printing region 15 in which printing is performed by the discharge head 5 is provided between the setting position S and the print start position K.

The carriage 17 is configured to be movable in a scan direction B intersecting the motion direction A of the set tray 3 by using a carriage scan mechanism (not illustrated). One end on the scan direction B at which the carriage 17 stops is a home position, and a capping mechanism 7 capable of sealing a nozzle-forming face of the discharge head 5 is arranged below the home position.

The discharge head 5 introduces ink supplied from an ink cartridge 16 via an ink supply flow path 21 (see FIG. 2) and performs printing by discharging the introduced ink onto the printing medium T. In the present embodiment, a serial-type head that performs printing while the carriage 17 is reciprocating in the scan direction B is used as the discharge head 5. Further, five nozzle lines corresponding to ink of five colors consisting of cyan (C), magenta (M), yellow (Y), black (K), and white (W) are formed in the discharge head 5 of the present embodiment. Each of these nozzle lines is formed of 180 nozzles 10 (see FIG. 2), for example.

The white ink described above is ink containing a white-based pigment component and is a type of white-based liquid. Titanium dioxide is preferably used as the white-based pigment. Note that "white-based" may refer to a color visually recognized as white and may include slightly tinged white referred to as off-white or ivory white, for example, without being limited to achromatic white.

Further, in the present embodiment, the white ink includes a sedimentation component having a larger specific gravity than a solution component of the ink and, compared with ink of other colors, tends to have a higher quantity of the sedimentation component. The sedimentation component is a pigment component, for example, and when sedimentation components settle over time, the concentration of sedimentation components may become unbalanced and cause a change in the hue of the ink. Accordingly, to overcome such a problem, in the printer 1 of the present embodiment, an ink circulation flow path C (see FIG. 2) used for stirring ink is provided in the ink supply flow path 21 that supplies ink from the ink cartridge 16 to the discharge head 5.

Figure 2:
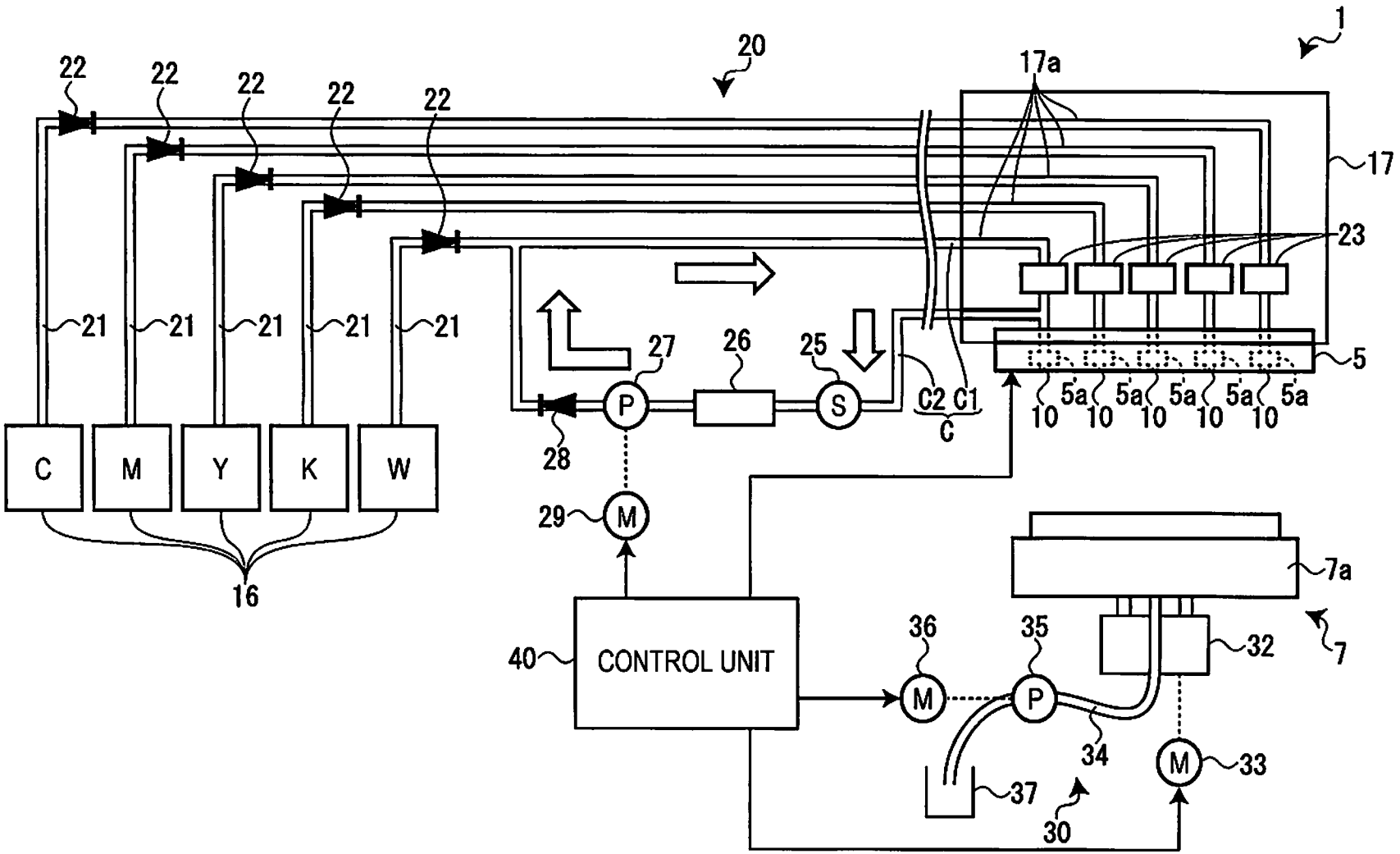
FIG. 2 is a schematic diagram of an ink supply unit and a maintenance unit.

FIG. 2 is a schematic diagram illustrating an ink supply unit 20 that includes the ink supply flow path 21 and the ink circulation flow path C described above and a maintenance unit 30 that performs maintenance of the discharge head 5. The ink supply unit 20 includes, for each color, the ink supply flow path 21 that is a flow path used for supplying ink from the ink cartridge 16 to the discharge head 5, a check valve 22 provided in the ink supply flow path 21, an in-carriage flow path 17*a* that is a flow path inside the carriage 17 in communication with the ink supply flow path 21, and a carriage filter 23 provided in the in-carriage flow path 17*a*. That is, ink of each color retained in the ink cartridge 16 is supplied to the nozzle 10 of the discharge head 5 via the ink supply flow path 21 and the in-carriage flow path 17*a*.

The ink supply flow path 21 is formed of a flexible ink tube and includes a sliding portion that slides in response to motion of the carriage 17. In FIG. 2, illustration of the sliding portion of the ink supply flow path 21 is omitted. Note that the ink circulation flow path C is formed of a flexible ink tube, and illustration of the sliding portion thereof is omitted. The check valve 22 is to suppress a reverse flow of ink in the ink supply flow path 21, namely, to enable the ink to flow from the ink cartridge 16 side to the discharge head 5 side, and suppresses the ink from flowing in the reverse direction from the discharge head 5 side to the ink cartridge 16 side.

The carriage filter 23 suppresses foreign material in the ink supply flow path 21 from entering a pressure generation chamber 5*a*. The carriage filter 23 functions to suppress the nozzle 10 from becoming clogged, which may be caused by foreign material being supplied to the discharge head 5. Further, although not illustrated, a self-sealing valve used for adjusting a flow pressure of ink is provided on the downstream side of the carriage filter 23 of the in-carriage flow path 17*a*. Note that the term "downstream side" refers to the discharge head 5 side rather than the ink cartridge 16 side in the ink supply flow path 21 and the in-carriage flow path 17*a*. Furthermore, the downstream side of the self-sealing valve communicates with an in-head flow path of the discharge head 5, and the pressure generation chamber 5*a* in communication with the nozzle 10 is provided in the in-head flow path. A piezoelectric element is provided in the pressure generation chamber 5*a*, and repeated expansion and contraction of the piezoelectric element causes the ink to be discharged from the nozzle 10. Note that, instead of the piezoelectric element, a heater used for discharging ink from the ink nozzle 10 by using bubbles generated from the heated ink may be provided.

On the other hand, the ink circulation flow path C is provided in the ink supply flow path 21 corresponding to the white ink out of the five ink supply flow paths 21 corresponding to the inks of five colors. In the ink circulation flow path C, with ink being circulated, a solution component and a sedimentation component of the ink are mixed so as to reduce the amount of the sedimentation component of the ink discharged from the nozzle 10 and thereby suppress a change in the hue of the ink from occurring.

The ink circulation flow path C has a forward circulation path C1 and a reverse circulation path C2. The forward circulation path C1 is a part of the ink supply flow path 21, and ink supplied from the ink cartridge 16 to the discharge head 5 flows therein. The downstream end of the forward circulation path C1 is located on the downstream side of the carriage filter 23 in the in-carriage flow path 17*a*. That is, the carriage filter 23 is provided in the forward circulation path C1. Further, the downstream end of the forward circulation path C1 is connected to the upstream end of the reverse circulation path C2. As described above, in the present embodiment, the carriage filter 23 is provided inside the ink circulation flow path C. Although agglomerated ink having a particle diameter smaller than foreign material particles may be deposited in a mesh portion and cause the carriage filter 23 to clog, such agglomerated ink can be washed away by circulating the ink in the ink circulation flow path C at a higher speed than during printing, thereby suppressing blocking of the carriage filter 23.

Note that the downstream end of the forward circulation path C1 and the upstream end of the reverse circulation path C2 may be located on the upstream side of the self-sealing valve described above or may be located on the downstream side of the self-sealing valve and the upstream side of the pressure generation chamber 5*a*. Note that the term "upstream side" refers to the ink cartridge 16 side rather than the discharge head 5 side in the ink supply flow path 21 and the in-carriage flow path 17*a*. Further, although not illustrated, the downstream end of the forward circulation path C1 may be located on the upstream side of the carriage filter 23 in the in-carriage flow path 17*a*. In such a case, ink agglomerated in the ink supply flow path 21 is captured by the circulation filter 26, and this can suppress the carriage filter 23 from becoming clogged with agglomerated ink.

On the other hand, ink returning to the ink supply flow path 21 from the discharge head 5 flows in the reverse circulation path C2. That is, of the ink supplied from the ink cartridge 16 to the discharge head 5 via the forward circulation path C1, ink which has not been discharged from the discharge head 5 is returned to the ink supply flow path 21 via the reverse circulation path C2. The downstream end of the reverse circulation path C2 is the upstream end of the forward circulation path C1.

In the reverse circulation path C2, a pressure sensor 25, a circulation filter 26, a circulation pump 27, and a check valve 28 are provided in this order from the upstream side. The circulation filter 26 is an example of a filter. The pressure sensor 25 determines a pressure inside the ink circulation flow path C. The circulation filter 26 is a filter that filters agglomerated ink in the ink circulation flow path C and is provided to suppress the carriage filter 23 from becoming blocked. A blocked state of the carriage filter 23 will require replacement of not only the carriage filter 23 but also the in-carriage flow path 17*a* and the ink supply flow path 21, which may be costly and time consuming. Thus, in the present embodiment, the circulation filter 26 is provided in the ink circulation flow path C to extend the life of the carriage filter 23. Note that the circulation filter 26 has a finer mesh and can capture more agglomerated ink than the carriage filter 23.

When the circulation filter 26 is provided in the ink circulation flow path C, however, a blocked state of the circulation filter 26 may increase the pressure in the ink circulation flow path C and cause ink leakage from the connection part of the forward circulation path C1 and the reverse circulation path C2. It is thus necessary to adjust the pressure in the ink circulation flow path C. Accordingly, in the present embodiment, a control unit 40 determines a blocked state of the circulation filter 26 in accordance with a detection value determined by the pressure sensor 25 and performs a circulation process of ink in the ink circulation flow path C in accordance with the determined blocked state of the circulation filter 26. Details thereof will be described later. Note that the control unit 40 is an example of the determination unit of the invention.

The circulation pump 27 circulates ink in the ink circulation flow path C in the direction of the white arrows illustrated in FIG. 2. A gear pump is preferably used as the circulation pump 27 because a gear pump can suppress ripple and has little flow variation over time. Further, the circulation pump 27 is driven by a circulation motor 29. The circulation motor 29 is an example of the motor in the invention. Further, the circulation pump 27 and the circulation motor 29 correspond to an example of the circulation unit of the invention. The circulation motor 29 is driven intermittently, and the drive period and the suspension period of the intermittent driving are controlled by the control unit 40. On the other hand, the check valve 28 enables the ink to flow in the ink circulation flow path C in the direction of the white arrows and suppresses the ink from flowing in the opposite direction.

Next, the maintenance unit 30 will be described. The maintenance unit 30 includes the capping mechanism 7, a waste liquid flow path 34 used for discarding ink, and a waste liquid retainer unit 37 that retains waste liquid.

The capping mechanism 7 includes a cap member 7*a* formed of a tray-like elastic material whose upper side is opened, an elevating device 32 that moves the capping mechanism 7 up and down, a maintenance motor 33 that is a drive source of the elevating device 32, an absorption pump 35 that reduces the pressure of the internal space of the cap member 7*a* to a negative pressure with the nozzle-forming face of the discharge head 5 being sealed, and an absorption motor 36 that is a drive source of the absorption pump 35.

The capping mechanism 7 is switched by an elevating operation of the elevating device 32 between a sealing state where the cap member 7*a* seals a nozzle-forming face of the discharge head 5 and a separation state where the cap member 7*a* is separated from the nozzle-forming face. Specifically, when a separation state is selected so that no printing operation on the printing medium T is performed by the discharge head 5 and when the printer 1 is powered off, the carriage 17 is positioned at the home position and the nozzle-forming face is capped by the capping mechanism 7. This suppresses evaporation of a solution component of ink from the nozzle-forming face.

Further, in a flushing operation, which is an operation to force accumulated ink or the like to be discharged from the discharge head 5, the cap member 7*a* functions as an ink reception member that receives ink ejected from the discharge head 5 without capping the nozzle-forming face in the separation state. Furthermore, in an absorption cleaning operation, which is an operation to remove ink, bubbles, or the like that have accumulated inside the discharge head 5 and to recover the nozzle from an unclogged state or the like, the absorption pump 35 is actuated in the capping state described above to reduce the pressure of the internal space of the cap member 7*a* to a negative pressure, and thereby the ink is forced to be discharged from the nozzle to the cap member 7*a*. The waste ink discharged to the cap member 7*a* is discharged to the waste liquid retainer unit 37 via the waste liquid flow path 34. Note that the flushing operation and the ink absorption operation correspond to an example of maintenance of the invention.

Note that an anti-drying cap used for suppressing evaporation of ink from the nozzle-forming face during a print suspension period, a wiper that wipes ink from the nozzle-forming face, a flushing box that accepts ink discharged from the discharge head 5, or the like may be provided at the home position in addition to the maintenance unit 30.

Figure 3:
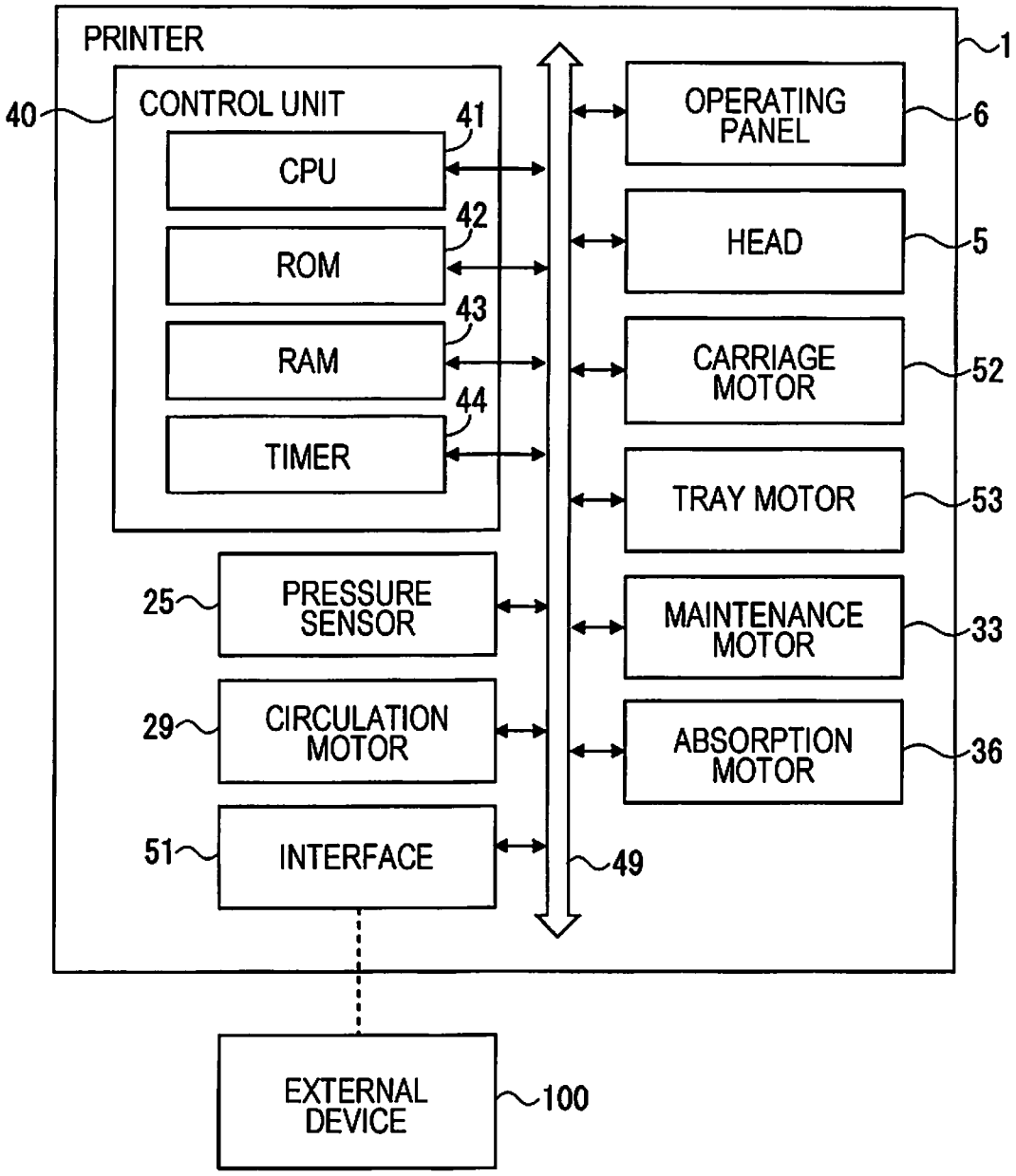
FIG. 3 is a block diagram illustrating a control configuration of the printer.

Next, a control system of the printer 1 will be described with reference to FIG. 3. The printer 1 includes, as components of the control system, the control unit 40, the pressure sensor 25, the circulation motor 29, an interface 51, the operating panel 6, the discharge head 5, a carriage motor 52, a tray motor 53, the maintenance motor 33, and the absorption motor 36, which are connected to each other via a bus 49.

The control unit 40 includes a central processing unit (CPU) 41, a read-only memory (ROM) 42, a random access memory (RAM) 43, and a timer 44. The CPU 41 is a processor that inputs and outputs signals to respective components within the printer 1 via the bus 49 and performs various calculation processes. Note that the processor may be formed of a plurality of CPUs or may be formed of a hardware circuit such as an application specific integrated circuit (ASIC).

The ROM 42 is a non-volatile storage medium and stores a program such as a firmware program therein. The RAM 43 is a volatile storage medium and is used as a work area of the CPU 41. The timer 44 measures the drive period and the suspension period when the circulation motor 29 is driven intermittently.

The pressure sensor 25 determines a pressure of the ink circulation flow path C in accordance with an instruction from the control unit 40. The circulation motor 29 drives the circulation pump 27 in accordance with a drive signal output from the control unit 40. The interface 51 receives various data including a print job from an external device 100. The external device 100 may be a personal computer, for example. The control unit 40 generates a drive waveform used for driving the discharge head 5 in accordance with the print job received from the external device 100.

The operating panel 6 is provided with operating buttons used by a user to perform various operations, a liquid crystal display that displays various information, or the like. When the control unit 40 determines that the circulation filter 26 is in a blocked state, for example, the operating panel 6 notifies the user of such determination. The user may use the operating panel 6 to select whether to replace the circulation filter 26 or continue usage. Further, the operating panel 6 displays an error indication when the control unit 40 determines that the blocked state of the circulation filter 26 is unable to be overcome.

The discharge head 5 discharges ink from the nozzle 10 in accordance with the drive waveform generated by the control unit 40. The carriage motor 52 drives a carriage scan mechanism in accordance with a drive signal output from the control unit 40 and moves the carriage 17. The tray motor 53 drives the timing belt 13 in accordance with a drive signal output from the control unit 40 and moves the support stage 12 to which the set tray 3 is attached.

The maintenance motor 33 drives the elevating device 32 in accordance with a drive signal output from the control unit 40 and moves the capping mechanism 7 up and down. The absorption motor 36 drives the absorption pump 35 in accordance with a drive signal output from the control unit 40 and causes the capping mechanism 7 to perform an ink absorption operation.

According to the configuration described above, the control unit 40 performs an ink circulation process in the ink circulation flow path C. More specifically, when the printer 1 is powered on and when no-operation state of the printer 1 continues for a certain period, the control unit 40 performs the ink circulation process. In the case of the former, when the no-operation period until power on is longer than a predetermined period, a first ink circulation process is performed in which the number of times that the circulation motor 29 is driven is a first designated number. Further, when the no-operation period until power on is shorter than or equal to the predetermined period, a second ink circulation process is performed in which the number of times that the circulation motor 29 is driven is a second designated number that is less than the first designated number. Furthermore, when the no-operation state of the printer 1 lasts for a certain period, a third ink circulation process is performed in which the number of times that the circulation motor 29 is driven is a third designated number that is less than the second designated number.

Further, in the first ink circulation process, the second ink circulation process, or the third ink circulation process, the control unit 40 drives the circulation motor 29 in a first mode after starting the process and until determining that the circulation filter 26 is in a blocked state in accordance with a detection result determined by the pressure sensor 25. After determining that the circulation filter 26 is in a blocked state, the control unit 40 drives the circulation motor 29 in a second mode in which the circulation rate is less than in the first mode. Note that the circulation rate is an amount determined by the flow rate of ink in the ink circulation flow path C in relation to the period during which the ink is circulated. Therefore, when it is assumed that the flow rate is zero when no ink is circulated, the circulation rate in each mode is determined by averaging the flow rate of ink during the process period in each mode. The control unit 40 changes the circulation rate by controlling the rotational rate, the drive period, and the suspension period of the circulation motor 29.

The first mode process to drive the circulation motor 29 in the first mode and the second mode process to drive the circulation motor 29 in the second mode will be described with reference to the flowcharts of FIG. 4 and FIG. 5. In the present embodiment, the rotational rate of the circulation motor 29 is constant.

Figure 4:
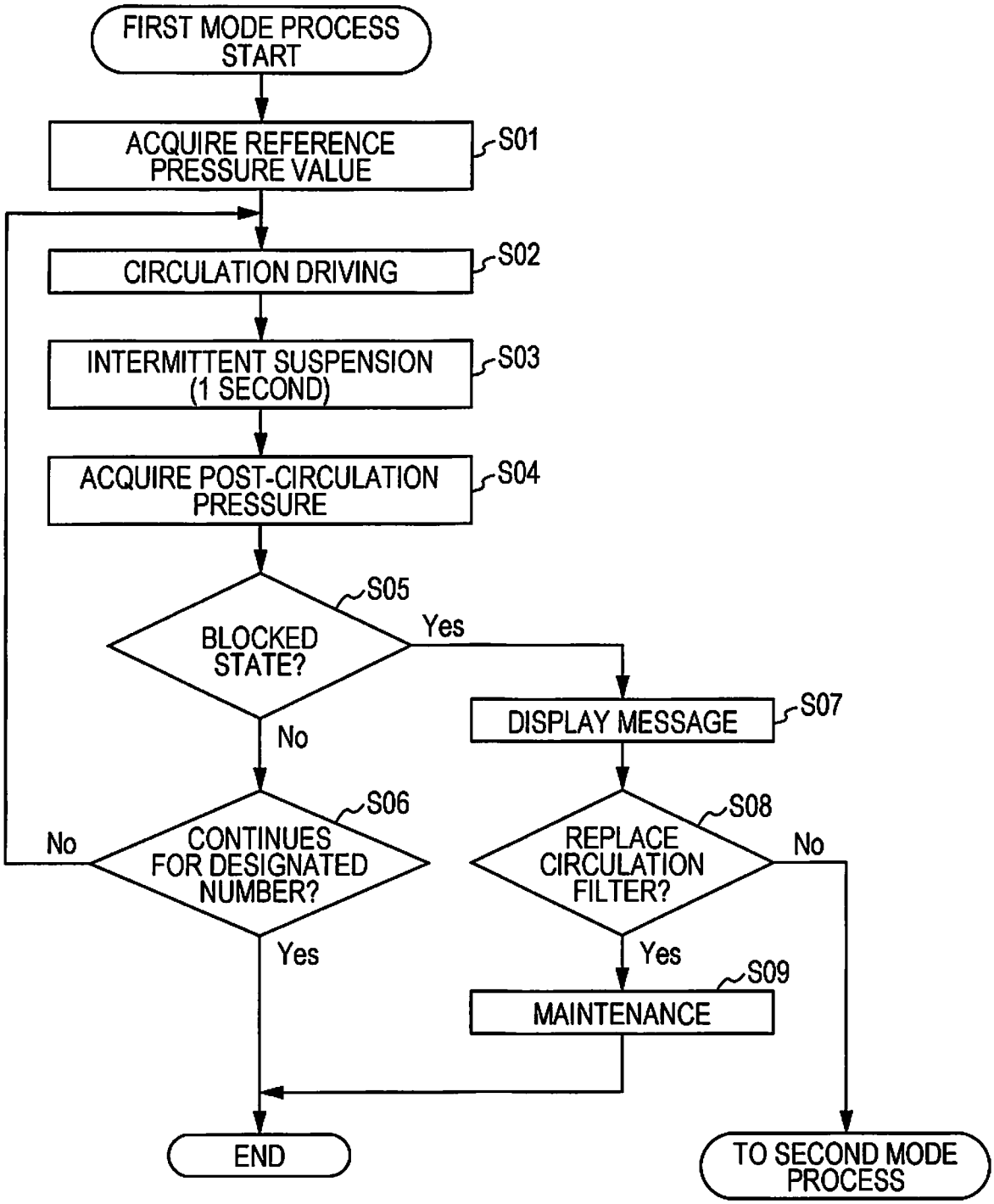
FIG. 4 is a flowchart illustrating a flow of a first mode process.

FIG. 4 is a flowchart illustrating the flow of the first mode process. Once starting the first mode process, the control unit 40 acquires a reference pressure value, which is a detection value determined by the pressure sensor 25 without ink being circulated in the ink circulation flow path C (step S01). The control unit 40 then drives the circulation motor 29 (step S02). The drive period in step S02 is a predetermined period such as 1 second, for example. The control unit 40 then intermittently suspends the circulation motor 29 (step S03). The suspension period in step S03 is a predetermined period such as 1 second, for example. Note that the suspension period in step S03 is an example of the first period of the invention. The control unit 40 acquires a post-circulation pressure value, which is a detection value determined by the pressure sensor 25, at the end of the suspension period in step S03 (step S04). Accordingly, detection is performed by the pressure sensor 25 in the suspension period of the circulation motor 29.

The control unit 40 calculates a differential pressure value, which is a value obtained by subtracting the reference pressure value acquired in step S01 from the post-circulation pressure value acquired in step S04 and, in accordance with the calculated differential pressure value, determines whether or not the circulation filter 26 is in a blocked state (step S05). Specifically, the control unit 40 determines that the circulation filter 26 is in a blocked state if the differential pressure value is greater than or equal to a first threshold, which is a predetermined threshold, (step S05: Yes) and determines that the circulation filter 26 is not in a blocked state if the differential pressure value is less than the first threshold (step S05: No). The first threshold is an example of the threshold in the invention. If it is determined that the circulation filter 26 is not in a blocked state (step S05: No), the control unit 40 determines whether or not the number of times that the circulation motor 29 is driven has reached a designated number (step S06). If it is determined that the designated number has been reached (step S06: Yes), the control unit 40 ends the first mode process. The designated number described herein refers to any one of a first designated number, a second designated number, and a third designated number corresponding to the types of ink circulation processes (a first ink circulation process, a second ink circulation process, and a third ink circulation process). If it is determined that the number of times that the circulation motor 29 is driven has not reached the designated number of the circulation motor 29 (step S06: No), the control unit 40 returns to step S02.

On the other hand, if it is determined that the circulation filter 26 is in a blocked state (step S05: Yes), the control unit 40 causes the operating panel 6 to display a message indicating that the circulation filter 26 is in a blocked state (step S07). If the user operates the operating panel 6 to instruct replacement of the circulation filter 26 in response to the message (step S08: Yes), the control unit 40 causes the maintenance unit 30 to perform maintenance (step S09) and ends the first mode process. Note that the maintenance in step S09 refers to a flushing operation to discharge a predetermined amount of ink and to an ink absorption operation to absorb a predetermined amount of ink. Further, if the user does not operate the operating panel 6 to instruct replacement of the circulation filter 26 or if the user operates the operating panel 6 to instruct continued use of the circulation filter 26 (step S08: No), the control unit 40 starts the second mode process.

Figure 5:
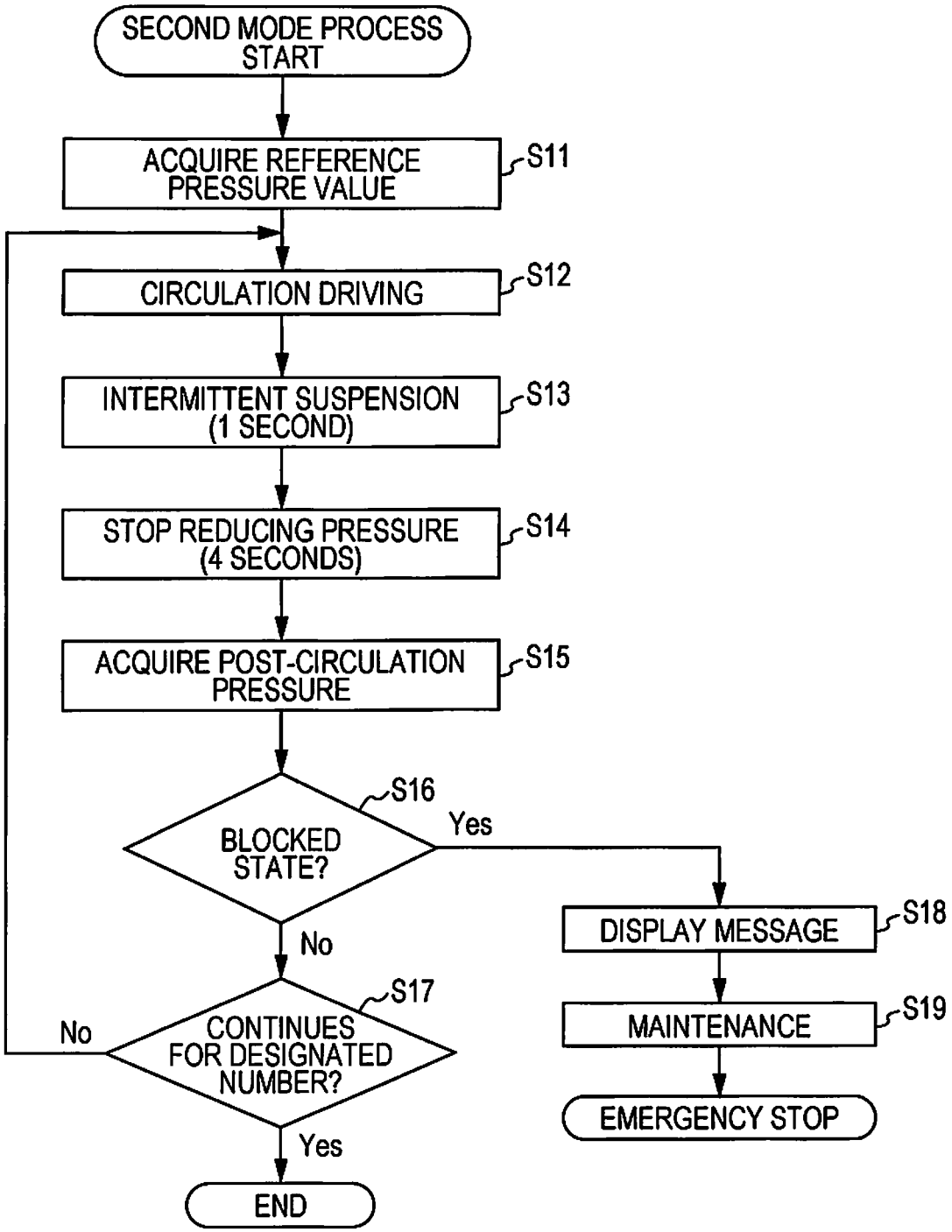
FIG. 5 is a flowchart illustrating a flow of a second mode process according to a first embodiment.

FIG. 5 is a flowchart illustrating a flow of the second mode process. Once starting the second mode process, the control unit 40 acquires a reference pressure value (step S11) and drives the circulation motor 29 (step S12). The drive period in step S12 may be, for example, 1 second as with the drive period in step S02 in the first mode process. The control unit 40 then intermittently suspends the circulation motor 29 (step S13). The suspension period in step S13 may be, for example, 1 second as with the suspension period in step S03. Further, the control unit 40 engages a suspension period for 4 seconds, for example, to reduce the pressure inside the ink circulation flow path C after the suspension period in step S13 has elapsed (step S14). Note that the sum of the suspension period in step S13 and the suspension period in step S14 is an example of the second period in the invention. The control unit 40 acquires a post-circulation pressure value as a detection value determined by the pressure sensor 25 at the end of the suspension period of step S14 (step S15).

The control unit 40 calculates a differential pressure value obtained by subtracting the reference pressure value acquired in step S11 from the post-circulation pressure value acquired in step S15 and determines whether or not the circulation filter 26 is in a blocked state in accordance with whether or not the calculated differential pressure value is greater than or equal to the first threshold (step S16). If it is determined that the circulation filter 26 is in a blocked state (step S16: No), the control unit 40 determines whether or not the number of times that the circulation motor 29 is driven has reached a designated number (step S17), and if it is determined that the designated number has been reached (step S17: Yes), the control unit 40 ends the second mode process. Note that it is determined in step S17 whether or not the total number of the number of times that the circulation motor 29 is driven in the first mode process and the number of times that the circulation motor 29 is driven in the second mode process, that is, the total number of times that the circulation motor 29 is driven after the ink circulation process was started has reached a designated number. If it is determined that the number of times that the circulation motor 29 is driven has not reached the designated number (step S17: No), the control unit 40 returns to step S12.

On the other hand, if it is determined that the circulation filter 26 is in a blocked state (step S16: Yes), the control unit 40 displays an error indication on the operating panel 6 (step S18). In such a case, the control unit 40 causes the maintenance unit 30 to perform maintenance (step S19) and applies an emergency stop of the printer 1. Note that the error indication in step S18 and the execution of maintenance of S19 may be performed in any order.

As described above, since the printer 1 according to the present embodiment has the circulation filter 26 provided in the ink circulation flow path C, it is possible to suppress the carriage filter 23 from being clogged. This realizes a longer life of the carriage filter 23 and can reduce time and cost taken for replacement of the carriage filter 23. Note that, since only the circulation filter 26 may be replaced when the circulation filter 26 is clogged, that is, when the circulation filter 26 is unable to be used, it is possible to suppress time and cost compared to a case of replacement of the carriage filter 23.

Further, the printer 1 performs the first mode process until determining that the circulation filter 26 provided in the ink circulation flow path C is in a blocked state and performs the second mode process after determining that the circulation filter 26 is in a blocked state, and it is therefore possible to continue the use of the circulation filter 26 even when the circulation filter 26 is in a blocked state. That is, although the circulation filter 26 approaching a blocked state may increase the pressure in the ink circulation flow path C and cause ink leakage, it is possible to continue to use the circulation filter 26 by selecting the second mode process of a lower circulation rate to suppress a rise in the pressure. Note that, in the second mode process illustrated in FIG. 5, since a suspension period is added in step S14 for the purpose of reducing the pressure, the rotation number of the circulation motor 29 per unit time is reduced, which results in a reduced circulation rate compared to the first mode process illustrated in FIG. 4.

Further, since the printer 1 determines a blocked state of the circulation filter 26 in accordance with a detection result determined by the pressure sensor 25, an accurate determination result is expected. Further, since the printer 1 detects the pressure value in the suspension period in intermittent driving of the circulation motor 29, detection can be performed without being affected by the ink flow rate. Further, in the ink circulation flow path C, because of being arranged on the upstream side of the circulation filter 26, the pressure sensor 25 is less likely to be affected by the circulation pump 27 compared to the case of being arranged on the downstream side of the circulation filter 26, and thus accurate detection can be performed.

Further, in the printer 1, the suspension period of the intermittent driving of the circulation motor 29 is the first period in the first mode process (1 second in the embodiment described above) and is the second period that is longer than the first period in the second mode process (5 seconds in the embodiment described above). With the first period and the second period being fixed in such a way, the drive control of the circulation motor 29 is simplified, and the process load of the CPU 41 can be reduced.

Further, when starting the first mode process and the second mode process, the printer 1 detects the reference pressure value, which is a pressure value when no ink circulates in the ink circulation flow path C, and determines a blocked state of the circulation filter 26 in accordance with whether or not a differential pressure value, which is the difference between the reference pressure value and the post-circulation pressure value that is a detection value determined by the pressure sensor 25 after circulation driving, is greater than or equal to the first threshold. It is therefore possible to remove influence of the air pressure and perform accurate determination.

Further, since the printer 1 causes the maintenance unit 30 to perform maintenance when it is determined that the circulation filter 26 is in a blocked state in the second mode process, it is possible to reduce the pressure value in the ink circulation flow path C. Thereby, ejection of ink out of the ink circulation flow path C can be suppressed such as during replacement of the circulation filter 26 after emergency stop of the printer 1.

Second Embodiment

Next, a second embodiment of the invention will be described. While the second period, which is the suspension period in the intermittent driving of the circulation motor 29, is fixed in the second mode process in the first embodiment described above, the second period is variable in the present embodiment. Features different from those of the first embodiment will be mainly described below. Note that, in the present embodiment, the same components as those in the first embodiment are labeled with the same reference numerals, and the detailed description thereof will be omitted. Further, a modified example applied to the same component as that in the first embodiment is applicable to the present embodiment in the same manner.

Figure 6:
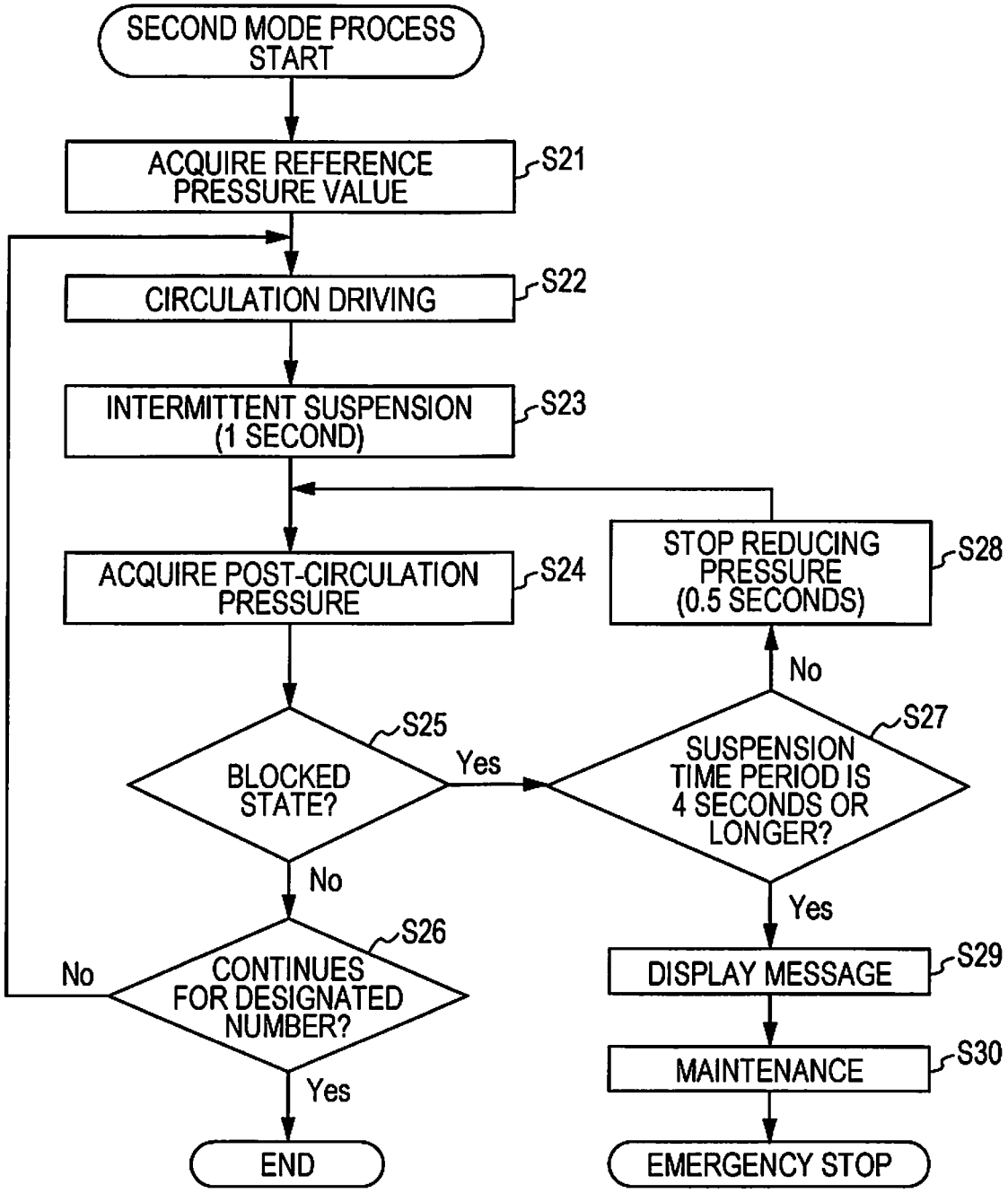
FIG. 6 is a flowchart illustrating a flow of a second mode process according to a second embodiment.

FIG. 6 is a flowchart illustrating a flow of the second mode process according to the second embodiment. Once starting the second mode process, the control unit 40 acquires the reference pressure value (step S21) and drives the circulation motor 29 (step S22). The control unit 40 then intermittently suspends the circulation motor 29 (step S23). The suspension period in step S23 may be, for example, 1 second in the same manner as the suspension period in step S13 in the first embodiment. Further, at the end of the suspension period in step S23, the control unit 40 acquires a post-circulation pressure value, which is a detection value determined by the pressure sensor 25 (step S24).

The control unit 40 calculates a differential pressure value, which is a value obtained by subtracting the reference pressure value acquired in step S21 from the post-circulation pressure value acquired in step S24, and determines whether or not the circulation filter 26 is in a blocked state in accordance with whether the calculated differential pressure value is greater than or equal to the first threshold (step S25). If it is determined that the circulation filter 26 is not in a blocked state (step S25: No), the control unit 40 determines whether or not the number of times that the circulation motor 29 is driven has reached the designated number (step S26) and, if it is determined that the designated number (step S26: Yes), ends the second mode process. Further, if it is determined that the number of times that the circulation motor 29 is driven does not reach the designated number (step S26: No), the control unit 40 returns to step S22.

On the other hand, if it is determined that the circulation filter 26 is in a blocked state (step S25: Yes), the control unit 40 determines whether or not the sum of the suspension periods in the loop process of steps S24, S25, S27, and S28 is longer than or equal to 4 seconds (step S27). When Yes is determined in step S25 for the first time after the second mode process is started, since the sum of suspension periods is 0 second, it is determined that the sum of suspension periods is not greater than or equal to 4 seconds (step S27:

No). In this case, the control unit 40 takes a suspension period of 0.5 seconds, for example, to reduce the pressure value inside the ink circulation flow path C (step S28) and returns to step S24. Note that the sum of the suspension periods of steps S23 and S28 is an example of the second period of the invention.

Further, if the loop process of steps S24, S25, S27, and S28 has been repeated and it is thus determined that the sum of the suspension periods is longer than or equal to 4 seconds (step S27: Yes), the control unit 40 displays an error indication on the operating panel 6 (step S29), causes the maintenance unit 30 to perform maintenance (step S30), and then applies emergency stop of the printer 1. Note that, in the present embodiment, since 0.5 seconds of the suspension period is added in step S28, it is determined that the sum of the suspension periods is longer than or equal to 4 seconds in step S27 when Yes has been determined in step S25 for nine times after the second mode process is started. Therefore, in the present embodiment, the upper limit of the sum of the suspension periods of steps S23 and S28 is 5 seconds.

As described above, the printer 1 according to the present embodiment changes the second period, which is a suspension period in intermittent driving of the circulation motor 29, in accordance with a detection result determined by the pressure sensor 25. Thus, the time required for an ink circulation process can be reduced compared to the first embodiment in which the second period is fixed. Further, since the suspension period is shorter in the present embodiment than in the first embodiment, an advantage that the ink flow rate in the ink circulation flow path C is less likely to decrease and the circulation performance is less likely to decrease can be obtained.

While two embodiments have been described above, without being limited to these embodiments, the following modified examples can be employed.

First Modified Example

While the blocked state of the circulation filter 26 is determined in accordance with a detection result determined by the pressure sensor 25 in the embodiments described above, the blocked state of the circulation filter 26 may be determined by other methods. For example, it may be determined that the circulation filter 26 is in a blocked state when the number of times of performing an ink circulation process has reached a predetermined number. An ink circulation process as used herein refers to performing circulation driving for a predetermined designated number of times (see step S02 in FIG. 4, step S12 in FIG. 5, and step S22 in FIG. 6). Further, it may be determined that the circulation filter 26 is in a blocked state when the number of times of circulation driving has reached a predetermined number or when the number of times that the circulation motor 29 is driven has reached a predetermined number.

Second Modified Example

While the circulation motor 29 is intermittently driven in the ink circulation process in the embodiments described above, the circulation motor 29 is not necessarily required to be driven intermittently. In such a case, a circulation rate is changed by adjusting the rotation number per unit time of the circulation motor 29. Further, the rotation number per unit time of the circulation motor 29 is not necessarily required to be smaller in the first mode process than in the second mode process, and the ink flow rate may be increased by temporarily increasing the rotation number in the second mode process.

Third Modified Example

While the blocked state of the circulation filter 26 is determined in accordance with the differential pressure value, which is a difference between the reference pressure value and the post-circulation pressure value, in the embodiments described above, it is not necessarily required to determine the reference pressure value. In such a case, the blocked state of the circulation filter 26 may be determined in accordance with whether or not the post-circulation pressure value is greater than or equal to a threshold.

Fourth Modified Example

While the ink circulation flow path C is provided in the ink supply flow path 21 for the white ink in the embodiments described above, the ink circulation flow path C may be provided in the ink supply flow path 21 for ink of one or other colors as well or instead.

Fifth Modified Example

While all the thresholds used for determining the blocked state of the circulation filter 26 are the same first threshold in the embodiments described above (see step S05 in FIG. 4, step S16 in FIG. 5, step S25 in FIG. 6), the thresholds may be different between the first mode process and the second mode process. In such a case, it is preferable to set the threshold used in the first mode process to be higher than the threshold used in the second mode process. Further, as another modified example, the threshold used for determining the blocked state of the circulation filter 26 may be changed in accordance with an ink color or an environment temperature. Further, as yet another modified example, the threshold used for determining the blocked state of the circulation filter 26 may be designated by a user. In such a case, the threshold may be able to be designated from the operating panel 6 or the external device 100.

Sixth Modified Example

While all the drive periods of circulation driving of the circulation motor 29 are the same (see step S02 in FIG. 4, step S12 in FIG. 5, step S22 in FIG. 6) in the embodiments described above, the drive period may be different between the first mode process and the second mode process. Further, as another modified example, the drive period of circulation driving may be changed in accordance with an ink color or an environment temperature. Further, as yet another modified example, the drive period of circulation driving may be designated by a user.

Seventh Modified Example

While the suspension period in step S28 in FIG. 6 is a predetermined time in the second embodiment (0.5 seconds in the second embodiment), the suspension period may be changed in accordance with a post-circulation pressure value acquired in step S24. For example, the suspension period may be longer when the post-circulation pressure value is less than a second threshold than when the post-circulation pressure value is greater than or equal to the second threshold. In such a case, the second threshold is larger than the first threshold that is a determination threshold of the blocked state of the circulation filter 26 in step S25. Further, the suspension period in step S28 will be a period whose upper limit is shorter than a period obtained by subtracting the suspension period in step S23 (1 second in the second embodiment) from the upper limit of the sum of the suspension periods (3.5 seconds in the second embodiment). Further, as another modified example, a suspension period in step S28 in FIG. 6 may be designated by a user. Further, the suspension period in step S23 in FIG. 6 may be designated by a user. Similarly, the suspension period in the first embodiment (see step S03 in FIG. 4 and steps S13 and S14 in FIG. 5) may be designated by a user.

Eighth Modified Example

While the circulation filter 26 is arranged between the pressure sensor 25 and the circulation pump 27 in the reverse circulation path C2 in the embodiments described above, other arrangements may be possible as long as the circulation filter 26 is arranged on the upstream side of the circulation pump 27 of the reverse circulation path C2.

Ninth Modified Example

While the in-carriage flow path 17*a* is a part of the ink circulation flow path C in the embodiments described above, the ink circulation flow path C may be provided without using the in-carriage flow path 17*a*. In such a case, a branch flow path may be provided in the ink supply flow path 21, the upstream end and the downstream end of the branch flow path may be connected to the downstream end and the upstream end of a partial flow path that is a part of the ink supply flow path 21, respectively, and thereby the branch flow path and the partial flow path may form the ink circulation flow path C. Further, as another modified example, the in-head flow path inside the discharge head 5 may be a part of the ink circulation flow path C. In such a case, the carriage filter 23 may be provided in the in-head flow path that is a part of the ink circulation flow path C.

Tenth Modified Example

While a flushing operation to discharge a predetermined amount of ink and an ink absorption operation to absorb a predetermined amount of ink are performed in maintenance before emergency stop of the printer 1 is applied in the embodiments described above, either one of the operations may be performed, although neither need be performed. Further, in accordance with the post-circulation pressure value acquired in step S24 before the emergency stop, it may be determined whether to perform only the flushing operation, only the ink absorption operation, or both the operations. Furthermore, an amount of discharged ink in the flushing operation or an amount of absorbed ink in the ink absorption operation may be changed in accordance with the post-circulation pressure value acquired in step S24 before the emergency stop.

Other Modified Examples

A method of executing each process of the printer 1 illustrated in each of the embodiments and the modified examples described above, a program for executing each process of the printer 1, and a computer readable storage medium in which the program is stored are included in the scope of the invention. Further, without being limited to the printer 1, the invention is applicable to a liquid discharge device that discharges a liquid containing a component that may cause sedimentation. In addition, various modifications are possible within the scope of the invention.

This application claims priority under 35 U.S.C. § 119 to Japanese Patent Application No. 2018-032367, filed Feb. 26, 2018. The entire disclosure of Japanese Patent Application No. 2018-032367 is hereby incorporated herein by reference.

What is claimed is:

1. A printer device comprising:

an ink circulation flow path to circulate ink;

an ink discharge unit to discharge the ink supplied from an ink cartridge;

an ink supply flow path to supply the ink from the ink cartridge to the ink discharge unit;

a first filter disposed between the ink cartridge and the ink discharge unit in the ink supply flow path;

a circulation unit to circulate the ink in the ink circulation flow path;

a second filter provided in the ink circulation flow path;

a determination unit to determine whether the second filter is in a blocked state; and a control unit to control the circulation unit, wherein one end of the ink circulation flow path is connected to the ink supply flow path between the first filter and the ink discharge unit, and an other end of the ink circulation flow path is connected to the ink supply flow path between the ink cartridge and the first filter, and the control unit is configured to drive the circulation unit in a first mode until the determination unit determines that the second filter is in a blocked state, and after the determination unit determines that the second filter is in the blocked state, the control unit is configured to drive the circulation unit in a second mode that provides a lower circulation rate than the first mode.

2. The device according to claim 1 further comprising a pressure sensor for determining a pressure in the ink circulation flow path, wherein the determination unit is configured to determine in accordance with a detection result determined by the pressure sensor whether the second filter is in a blocked state.

3. The device according to claim 2, wherein the circulation unit is configured to circulate the ink by performing intermittent driving of a motor, and wherein the pressure sensor is for determining the pressure in a suspension period of the intermittent driving.

4. The device according to claim 3, wherein the first mode is a mode in which a suspension period of the intermittent driving is a first period, and the second mode is a mode in which a suspension period of the intermittent driving is a second period that is longer than the first period.

5. The device according to claim 4, wherein each of the first period and the second period is a fixed period.

6. The device according to claim 4, wherein the control unit is configured to change the second period in accordance with a detection result determined by the pressure sensor.

7. The device according to claim 6 further comprising a maintenance unit to perform maintenance of the ink discharge unit by causing the ink discharge unit to discharge ink, wherein when the circulation unit is driven in the second mode and a state where the determination unit determines that the second filter is in a blocked state continues to an upper limit of the second period, the control unit is configured to apply an emergency stop of the printer device after causing the maintenance unit to perform the maintenance.

8. The device according to claim 2, wherein the pressure sensor is for determining a reference pressure value that is a pressure value corresponding to a state where the ink is not circulated in the ink circulation flow path, and wherein when a differential pressure value that is a difference between the reference pressure value and a detection value determined by the pressure sensor is greater than or equal to a threshold, the determination unit determines that the second filter is in a blocked state.

9. A printer device comprising:

an ink circulation flow path to circulate ink;

an ink discharge unit to discharge the ink supplied from the ink circulation flow path;

a circulation unit to circulate the ink in the ink circulation flow path, the circulation unit being configured to circulate the ink by performing intermittent driving of a motor;

a filter provided in the ink circulation flow path;

a pressure sensor for determining a pressure in the ink circulation flow path, the pressure sensor being for determining the pressure in a suspension period of the intermittent driving;

a determination unit to determine whether the filter is in a blocked state, the determination unit being configured to determine in accordance with a detection result determined by the pressure sensor whether the filter is in the blocked state;

a control unit to control the circulation unit and a maintenance unit to perform maintenance of the ink discharge unit by causing the ink discharge unit to discharge ink, wherein wherein the control unit is configured to drive the circulation unit in a first mode until the determination unit determines that the filter is in a blocked state, and after the determination unit determines that the filter is in the blocked state, the control unit is configured to drive the circulation unit in a second mode that provides a lower circulation rate than the first mode, the first mode is a mode in which a suspension period of the intermittent driving is a first period, and the second mode is a mode in which a suspension period of the intermittent driving is a second period that is longer than the first period, and each of the first period and the second period is a fixed period, and when the circulation unit is driven in the second mode and the determination unit determines that the filter is in a blocked state, the control unit is configured to apply an emergency stop of the printer device after causing the maintenance unit to perform the maintenance.

* * * * *